US005488936A

United States Patent [19]

Rychlick et al.

[11] Patent Number: 5,488,936

[45] Date of Patent: Feb. 6, 1996

[54] METHOD AND SYSTEM FOR MONITORING EVAPORATIVE PURGE FLOW

[75] Inventors: Edward G. Rychlick, Dearborn; Patrick J. Curran, Farmington Hills; Douglas J. Mancini, Farmington, all of Mich.

[73] Assignee: Ford Motor Company, Dearborn, Mich.

[21] Appl. No.: 304,324

[22] Filed: Sep. 12, 1994

[51] Int. Cl.[6] ..... F02M 37/04

[52] U.S. Cl. ..... 123/520; 123/198 D

[58] Field of Search ..... 123/520, 519, 123/518, 516, 198 D

[56] References Cited

U.S. PATENT DOCUMENTS

| | | | |
|---|---|---|---|
| 4,867,126 | 9/1989 | Yonekawa | 123/198 D |
| 5,085,194 | 2/1992 | Kuroda | 123/198 D |
| 5,105,789 | 4/1992 | Aramaki | 123/198 D |
| 5,230,319 | 7/1993 | Otsuka | 123/198 D |
| 5,265,577 | 11/1993 | Denz | 123/198 D |
| 5,313,925 | 5/1994 | Otsuka | 123/198 D |
| 5,353,771 | 10/1994 | Blumenstock | 123/198 D |
| 5,359,980 | 11/1994 | Tomisawa | 123/520 |

*Primary Examiner*—Carl S. Miller

*Attorney, Agent, or Firm*—Peter Abolins; Roger L. May

[57] ABSTRACT

An evaporative purge flow monitoring system is provided for use in a motor vehicle having an internal combustion engine, a fuel tank, and an evaporation canister in communication with the fuel tank and the engine for trapping and subsequently reusing fuel vapor dispelled from the fuel tank. The evaporative purge flow monitoring system includes a vapor management valve interposed between the engine and the evaporation canister. An Electronic Engine Control (EEC) assembly is further provided in communication with the vapor management valve and the engine wherein the EEC assembly is provided with a test logic to determine satisfactory operation of the vapor management valve. The test logic determines whether the vapor management valve is defective based on either the presence of significant fuel vapor as determined by the test logic or a change in an engine performance parameter generated within the EEC assembly without requiring a separate sensor when the vapor management valve is temporarily closed.

17 Claims, 3 Drawing Sheets

METHOD AND SYSTEM FOR MONITORING EVAPORATIVE PURGE FLOW

TECHNICAL FIELD

The present invention relates generally to fuel tank ventilation systems. In particular, the present invention relates to a method and on-board diagnostic system for monitoring evaporative fuel vapor purge flow in a motor vehicle for the purpose of determining whether the purge system is functioning properly.

BACKGROUND ART

Evaporative emission control systems are widely used in internal combustion engine powered motor vehicles to prevent evaporative fuel, i.e., fuel vapor, from being emitted from the fuel tank into the atmosphere. Typically, a vapor management valve (or evaporation canister purge valve) can be found in an internal combustion engine powered motor vehicle to control evaporative emission.

The vapor management valve is a normally closed solenoid that is mounted in line between an evaporation canister and the intake manifold of an internal combustion engine. In operation, when the Electronic Engine Control (EEC) assembly energizes the solenoid, the solenoid opens, thus allowing the intake manifold vacuum to draw fuel vapors from the canister into the cylinders for combustion. In contrast, when the EEC assembly de-energizes the solenoid, fuel vapors from the fuel tank are stored in the evaporation canister.

Federal law has been implemented to regulate the emission of fuel vapors into the atmosphere. As a result, it has become necessary to employ an on-board diagnostic system capable of detecting deficiencies in evaporative vapor emission control components and identifying such deficiencies so that corrective measures may be taken. In the event that one or more evaporative emission control components malfunctions, fuel vapors may be vented improperly resulting in reduced engine performance and possible release of vapors into the atmosphere.

The known prior art attempts to detect deficiencies in evaporative vapor emission control components by providing additional hardware to the vehicle system thereby adding additional cost to the vehicle which is passed on to a consumer.

In addition to adding cost to the vehicle, the additional hardware increases the number of parts that can fail, thereby increasing warranty concerns to the manufacturer of the vehicle.

DISCLOSURE OF THE INVENTION

It is thus a general object of the present invention to overcome the limitations of the prior art by providing a method and system for accurately monitoring evaporative purge flow without requiring additional hardware, such as a separate sensor.

A more specific object of the present invention is the provision of a method and system for detecting malfunctions in a vapor management valve by monitoring the change in the idle air bypass.

In carrying out the above objects, the method of the present invention is provided for use in a motor vehicle having an internal combustion engine, a fuel tank, and an evaporation canister in communication with the fuel tank and the engine for trapping and subsequently reusing fuel vapor dispelled from the fuel tank.

The method includes the step of determining whether a plurality of preselected test criteria have been satisfied. The method continues with the step of determining a first idle speed air bypass performance.

The method further includes the step of closing the vapor management valve so as to preclude flow of atmospheric air and fuel vapor from the evaporation canister into the engine.

Next, the method includes the step of determining a second idle speed air bypass performance after a predetermined amount of time. The method continues with the step of determining the difference between the first and second determined idle speed air bypass performance.

Still further, the method includes the step of comparing the determined idle speed air bypass performance differences to a predetermined idle speed air bypass performance range.

Finally, the method concludes with the step of indicating determined malfunctions in the vapor management valve if the determined idle speed air bypass difference is not within the predetermined idle speed air bypass performance range.

In further carrying out the above objects and other objects of the present invention, a system is also provided for carrying out the steps of the above described method. The system includes a vapor management valve interposed between the engine and the evaporation canister.

The system also includes an EEC assembly in electrical communication with the vapor management valve and the engine wherein the EEC assembly is provided with a test logic to determine satisfactory operation of the vapor management valve.

The test logic includes an initiation logic for initiating the test logic upon determining satisfaction of a plurality of preselected test criteria.

The test logic also includes a valve monitoring logic for determining a test value, the test value representing a change in an engine performance parameter generated within the EEC assembly without requiring a separate sensor.

The test logic further includes a first memory for storing an acceptance range and a comparator for comparing the test value to the acceptance range.

Still further, the test logic includes an output for generating a malfunction signal representative of a defective vapor management valve if the test value is not within the acceptance range.

The above objects, features and advantages of the present invention, as well as others, are readily apparent from the following detailed description of the best mode for carrying out the invention when taken in connection with the accompanying drawings.

BRIEF DESCRIPTION OF THE DRAWINGS

The present invention will be apparent from the detailed description taken in conjunction with the accompanying drawings in which.

BEST MODES FOR CARRYING OUT THE INVENTION

Figure 1:
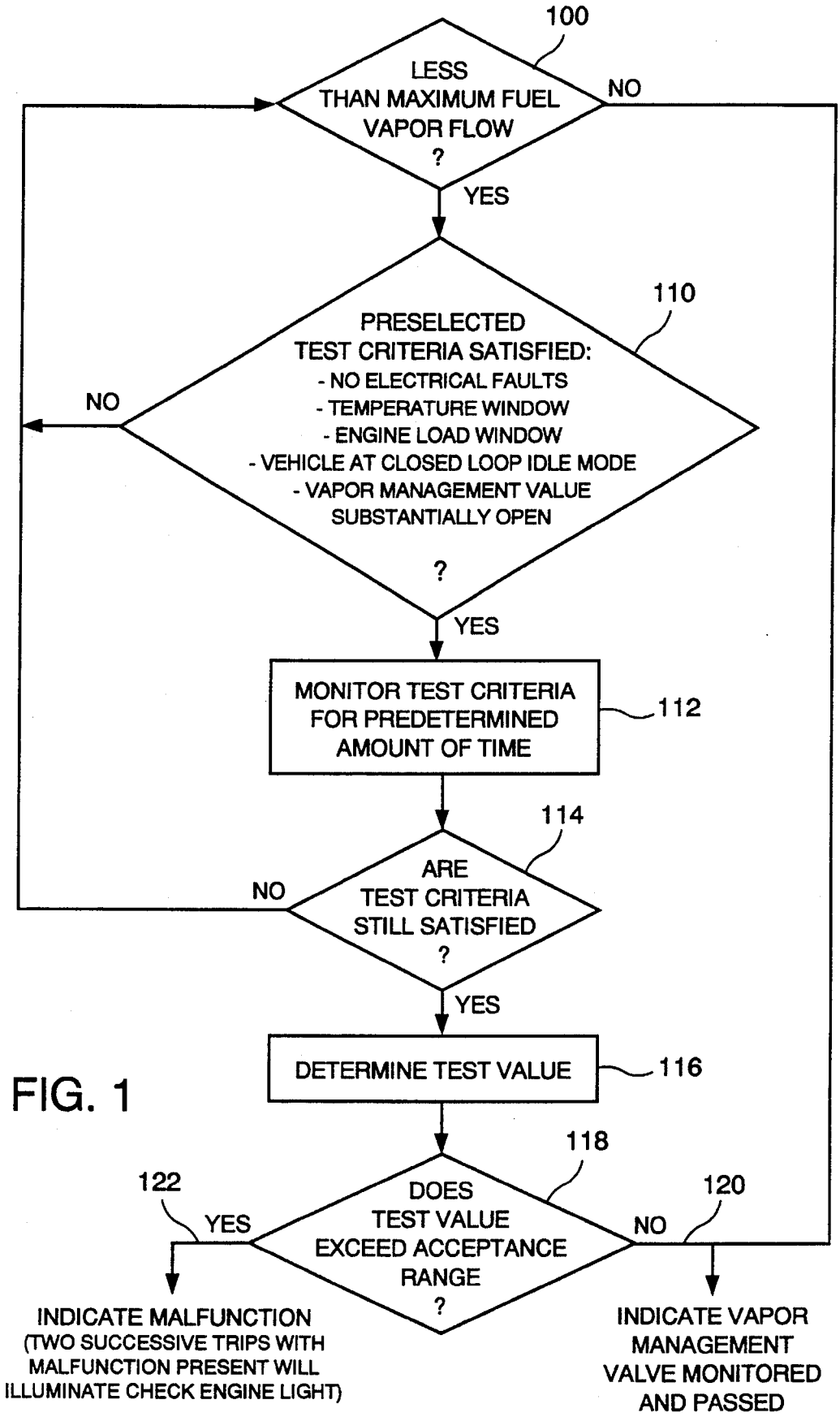
FIG. 1 is a block diagram illustrating the general sequence of steps associated with the operation of the present invention.

With reference to FIG. 1 of the drawings, there is provided a block diagram illustrating the general sequence of steps associated with the present invention.

The system of the present invention provides continuous monitoring of the vapor management valve comprising the evaporative emission control function. The vapor management valve is monitored once per each vehicle trip.

To ensure adequate readings, the monitoring system of the present invention is designed to be operable only when a plurality of preselected test criteria have been satisfied, as shown by blocks 100 and 110. The requirement of preselected test criteria is to compensate for false error signals which might be generated in the event substantial changes in the. engine load occurred between engine control measurements.

The first test criteria includes verifying that the system is at less than maximum fuel vapor flow, as shown by conditional block 100. If the vapor flow is significant, or at a maximum, the vapor management value is functioning and the monitoring system of the present invention is not initiated and an indication is provided that the vapor management valve was monitored and passed.

If the fuel vapor flow is less than maximum, then the monitoring system of the present invention proceeds to block 110 where an additional plurality of preselected criteria are monitored.

The plurality of preselected test criteria include verifying the vehicle is stopped and in closed loop idle mode. The plurality of preselected test criteria further include verifying there are no electrical faults in the system.

In addition, the plurality of preselected test criteria include a specified window or range of engine load, including no change in the air conditioner state and normal operating temperature.

Still further, the plurality of preselected test criteria include verifying the vapor management valve is substantially wide open.

After determining that the plurality of test criteria have been satisfied, the next step of the method includes monitoring the test criteria for a predetermined amount of time, such as ten seconds, to ensure stable engine performance, as shown by block 112.

Next, as shown by conditional block 114, the method continues with the step of determining whether the plurality of preselected test criteria are still satisfied. If the test criteria are no longer satisfied, the method returns to the first step 110.

If the test criteria are still satisfied, the method continues with the step of determining a test value as shown by block 116. The test value represents a change in an engine control parameter generated within the EEC assembly without requiring a separate sensor. In the present invention, the performance of the idle speed control valve is monitored since it is an engine control parameter that changes most rapidly when the vapor management valve is shut off, thereby precluding fuel vapor and air from entering the intake manifold of the engine.

The next step of the present invention includes determining whether the test value exceeds an acceptance range, as shown by block 118. The acceptance range is predetermined based on the known performance of the engine control parameter if it is functioning properly.

Since it is known how the engine idle speed control valve will react when the engine is running in the closed loop fuel control and air flow is reduced to the engine, the present invention can use an engine idle speed control signal generated within the EEC assembly as an indicator of vapor management valve operation. The vapor received from the evaporative canister, once the engine is running at a stable steady-state operation, contains some fuel. However, the air/fuel ratio of the vapor from the evaporative canister is very high. When the vapor management valve is closed during the diagnostic test, the engine continues to receive air and fuel from the conventional induction system via the idle air bypass and the fuel injector. As a result of the loss in air coming from the vapor management valve, there is a net reduction in the air/fuel ratio causing the engine to run rich. The change in the air/fuel ratio is sensed by the oxygen sensor which is part of the conventional closed loop fuel control which provides an exhaust oxygen signal to the EEC assembly.

The EEC assembly sensing the change in air/fuel ratio will command the idle speed control valve to let more air into the engine. Each engine will have a very predictable response to the closure of the vapor management valve when the engine is running at the steady state test condition. If the idle speed control valve does not react as predicted, one can determine that the vapor management valve is not functioning properly.

If the test value does not exceed the acceptance range, then the vapor management valve is functioning properly as shown by 120. If the test value does exceed the acceptance range, then a malfunction signal representing a defective vapor management valve is generated as shown by 122.

In an alternative embodiment, the method of the present invention further includes storing the malfunction signal generated into a memory upon detecting a defective vapor management valve. Next, the method includes indicating a malfunction of the vapor management valve to an operator of the motor vehicle.

Preferably, the step of indicating a malfunction of the vapor management valve to an operator of the vehicle is performed after at least two malfunction signals are generated. For a more accurate indication of a defect and to minimize the likelihood of a false error indication, the malfunction is not indicated to the operator unless at least two malfunction signals are generated in successive trips.

Figure 2:
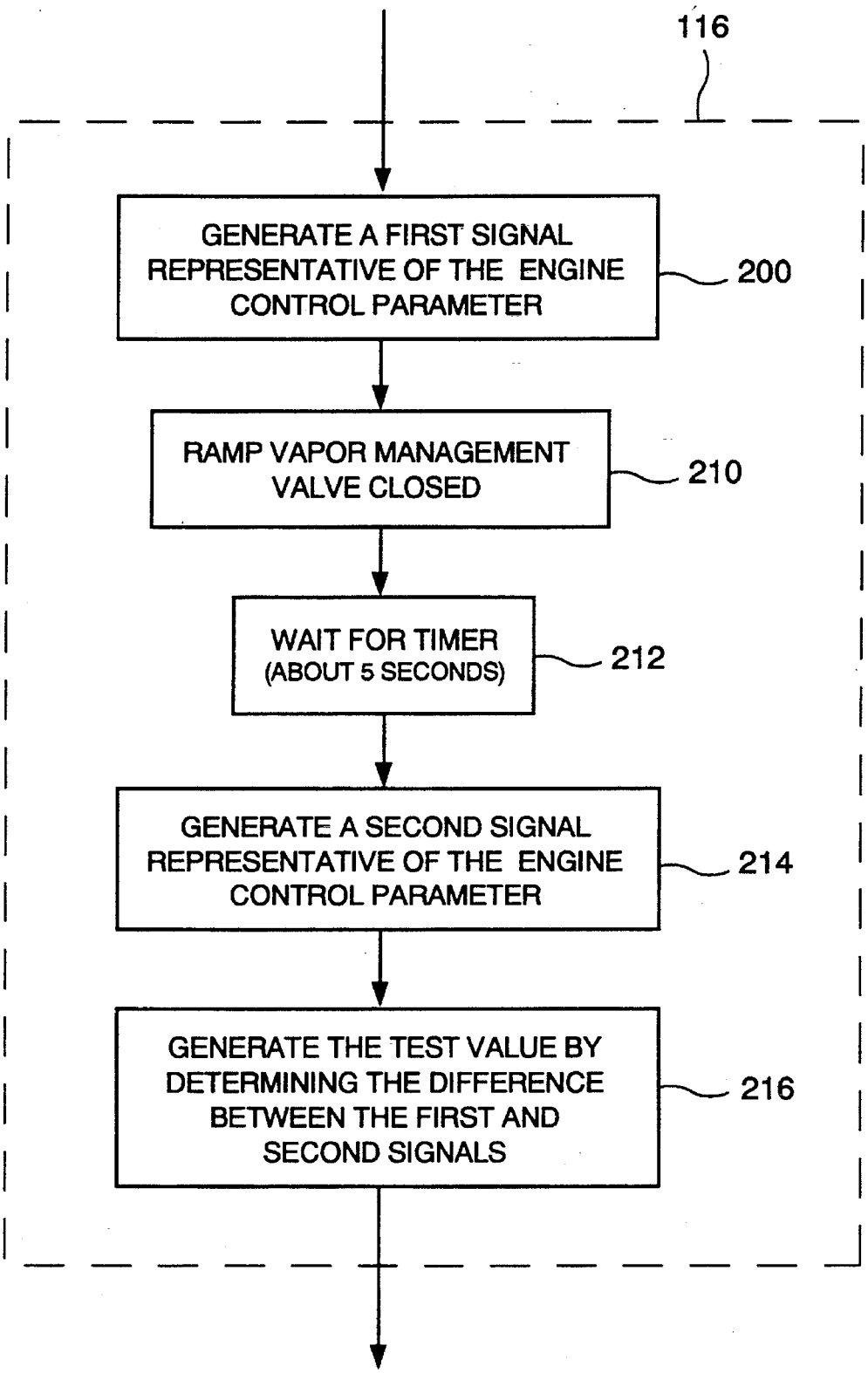
FIG. 2 is a block diagram illustrating the general sequence of steps associated with determining the test valve utilized in the present invention.

Turning now to FIG. 2, there is shown a block diagram illustrating the general sequence of steps associated with determining the test value utilized in the present invention.

As shown by block 200, the first step in determining the test value includes generating a first signal representative of the engine control parameter. In the present invention, the idle speed control valve is monitored.

Next, as shown by block 210, the vapor management valve is closed thereby precluding flow of air from the evaporation canister to the engine. As those skilled in the art will recognize, an instantaneous shutoff of the vapor management valve may result in undesirable effects on the operation of the internal combustion engine. Therefore, the valve is ramped closed.

The method continues with the step of providing a time out after the engine has had sufficient time to react to the shutting off of the vapor management valve, as shown by block 212. This reaction time is normally about five seconds.

Next, the method continues with the step of generating a second signal representative of the engine control parameter upon detecting the time out, as shown by block 214.

Finally, as shown by block 216, the method of determining the test value concludes with the step of generating the test value by determining the difference between the first and second signals. Alternatively, the test value is further determined by averaging the test value with a prior test value determined in a previous test.

Figure 3:
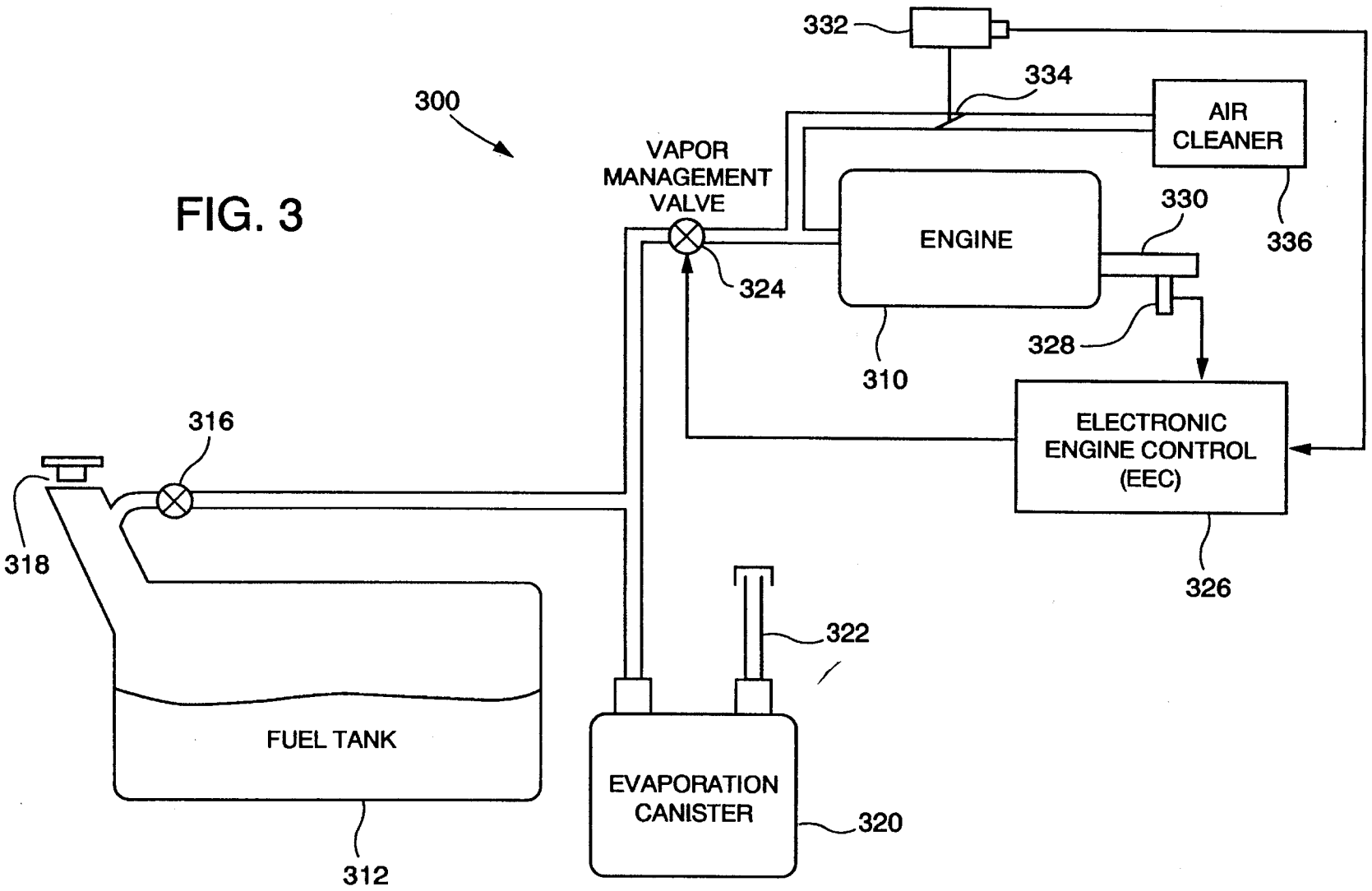
FIG. 3 is a block diagram of the present invention made in accordance with the teachings of the preferred embodiment of this invention.

With reference to FIG. 3 of the drawings, there is provided a block diagram of the evaporative purge flow monitoring system of the present invention designated generally by reference numeral 300. As shown, system 300 includes an internal combustion engine 310.

The system 300 also includes a fuel tank 312. The fuel tank 312 is a conventional fuel tank known by those of ordinary skill in the art. The fuel tank 312 typically includes a running loss vapor control valve 316 and a vacuum relief valve 318.

The system 300 further includes an evaporation canister 320 in communication with the fuel tank 312 and the engine 310 for trapping and subsequently reusing fuel vapor dispelled from the fuel tank 312. The evaporation canister 320 includes an atmospheric vent 322.

The system 300 also includes a vapor management valve 324. The vapor management valve 324 is interposed between the engine 310 and the evaporation canister 320. In the preferred embodiment, the vapor management valve 324 comprises a normally closed vacuum operated solenoid which is energized by the EEC assembly 326 via an electrical to vacuum converter integral with the valve 324.

When the vapor management valve 324 opens, it allows the vacuum of the intake manifold of the internal combustion engine 310 to draw fuel vapors from the evaporation canister 14 for combustion in the cylinders (not shown). When the EEC assembly 326 de-energizes the vapor management valve 324, fuel vapors are stored in the evaporation canister 320.

The EEC assembly 326 is in electrical communication with the vapor management valve 324 and the engine 310. The EEC assembly 326 is provided with a test logic to determine satisfactory operation of the vapor management valve 324.

The system also includes an oxygen sensor 328. The oxygen sensor 328 is disposed between the exhaust 330 of the engine 310 and the EEC assembly 326. The oxygen sensor 328 is utilized to measure the air content of the fumes dispelled by the engine 310. The oxygen sensor 328 may be any conventional oxygen sensor known by others having ordinary skill in the art.

The system 300 further includes an idle speed control valve 332. The idle speed control valve 332 controls the position of the throttle plate 334. which provides air to the engine from an air cleaner 336. The idle speed control valve 332 and the air cleaner 336 are typical components of an internal combustion engine.

The EEC assembly 326 responds to the amount of air sensed by the oxygen sensor 328. If the vapor management valve 324 is operating properly, the oxygen sensor 328 should sense a low amount of air when the vapor management valve is ramped closed and transmit this information to the EEC assembly 326. In response, the EEC assembly 326 then instructs the idle speed control valve 332 to open the throttle plate 334 to let in more air to the engine 310. If the vapor management valve 324 is not functioning properly, the amount of air sensed by the oxygen sensor 328 remains the same as prior to shutting off the valve 324. As a result, a malfunction signal is generated thereby alerting the operator of the vehicle of the defective vapor management valve 324.

While the best modes for carrying out the invention have been described in detail, those familiar with the art to which this invention relates will recognize various alternative designs and embodiments for practicing the invention as defined by the following claims.

What is claimed is:

1. For use in a motor vehicle having an internal combustion engine, an idle speed control valve for controlling the amount of air provided to the engine, a fuel tank for providing fuel to the engine, and an evaporation canister in communication with the fuel tank and the engine for trapping and subsequently reusing fuel vapor dispelled from the fuel tank, a method for monitoring evaporative purge flow comprising:

providing a vapor management valve interposed between the engine and the evaporation canister;

providing an Electronic Engine Control (EEC) assembly in electrical communication with the vapor management valve, the idle speed control valve and the engine, for determining satisfactory operation of the vapor management valve;

initiating a test sequence within the EEC assembly upon determining satisfaction of a plurality of preselected test criteria evidencing stable engine operation;

determining a test value, the test value representing a change in the idle speed control valve generated within the EEC assembly when the vapor management valve is temporarily closed;

comparing the test value to an acceptance range stored within the EEC assembly; and generating a malfunction signal representative of a defective vapor management valve if the test value is not within the acceptance range.

2. The method of claim 1 wherein the step of determining satisfaction of the plurality of preselected test criteria includes the step of determining a flow of the fuel vapor is less than a maximum vapor flow.

3. The method of claim 1 wherein the step of determining satisfaction of the plurality of preselected test criteria includes the step of monitoring the plurality of preselected test criteria for a predetermined amount of time prior to closing the vapor management valve.

4. The method of claim 1 wherein the step of determining satisfaction of the plurality of preselected test criteria includes the step of verifying an absence of electrical faults.

5. The method of claim 1 wherein the step of determining satisfaction of the plurality of preselected test criteria further includes the step of verifying a specified range of engine load and operating temperature.

6. The method of claim 1 wherein the step of determining satisfaction of the plurality of preselected test criteria further includes the step of verifying the vehicle is in a closed loop idle mode.

7. The method of claim 1 wherein the step of determining a test value comprises:

generating a first signal representative of the idle speed control valve;

shutting off the vapor management valve thereby precluding flow of the fuel vapor from the evaporation canister to the engine;

providing a time out after the engine has had sufficient time to react to the shutting off of the vapor management valve;

generating a second signal representative of the idle speed control valve upon detecting the time out; and generating the test valve by determining the difference between the first and second signals.

8. The method of claim 1 wherein the EEC assembly further comprises:

storing the malfunction signal generated by the output; and indicating a malfunction of the vapor management valve to an operator of the vehicle.

9. The method of claim 8 wherein the step of indicating a malfunction is performed after at least two malfunction signals are generated.

10. The method of claim 9 wherein the at least two malfunction signals are provided in successive trips.

11. For use in a motor vehicle having an internal combustion engine, a fuel tank, and an evaporation canister in communication with the fuel tank and the engine for trapping and subsequently reusing fuel vapor dispelled from the fuel tank, a method for monitoring evaporative purge flow comprising:

determining whether a plurality of preselected test criteria have been satisfied;

determining a first idle speed air bypass performance;

closing the vapor management valve so as to preclude flow of atmospheric air and fuel vapor from the evaporation canister into the engine;

determining a second idle speed air bypasses performance after a predetermined amount of time;

determining the difference between the first and second determined idle speed air bypass performance;

comparing the determined idle speed air bypass performance differences to a predetermined idle speed air bypass performance range; and indicating determined malfunctions in the vapor management valve if the determined idle speed air bypass difference is not within the predetermined idle speed air bypass performance range.

12. For use in a motor vehicle having an internal combustion engine, an idle speed control valve for controlling the amount of air provided to the engine, a fuel tank for providing fuel to the engine, and an evaporation canister in communication with the fuel tank and the engine for trapping and subsequently reusing fuel vapor dispelled form the fuel tank, a system for monitoring evaporative purge flow comprising:

a vapor management valve interposed between the engine and the evaporation canister;

an EEC assembly in electrical communication with the vapor management valve, the idle speed control valve and the engine to determine satisfactory operation of the vapor management valve;

an initiation logic for initiating a test sequence within the EEC assembly upon determining satisfaction of a plurality of preselected test criteria evidencing stable engine operation;

a valve monitoring logic for determining a test value, the test value representing a change in the idle speed control valve generated within the EEC assembly when the vapor management valve is temporarily closed;

a comparator for comparing the test value to an acceptance range stored within the EEC assembly; and an output for generating a malfunction signal representative of a defective vapor management valve if the test value is not within the acceptance range.

13. The system of claim 12 wherein the plurality of preselected test criteria are monitored continuously for a predetermined amount of time prior to initiating the test logic.

14. The system of claim 12 wherein the valve monitoring logic comprises:

means for generating a first signal representative of the idle speed control valve;

means for shutting off the vapor management valve thereby precluding flow of the fuel vapor from the evaporation canister to the engine;

a timer for providing a time out after the engine has had sufficient time to react to the shutting off of the vapor management valve;

means for generating a second signal representative of the idle speed control valve upon detecting the time out; and a processor for generating the test value by determining the difference between the first and second signals.

15. The system of claim 12 further comprising:

a memory for storing the malfunction signal generated by the output; and an operator discernible indicator for indicating a malfunction of the vapor management valve to an operator of the vehicle.

16. The system of claim 15 wherein the indicator indicates a malfunction after at least two malfunction signals are provided in successive trips by the output.

17. The system of claim 15 wherein the indicator is a visual display.

* * * * *